US007344286B1

(12) United States Patent
Petrie et al.

(10) Patent No.: US 7,344,286 B1
(45) Date of Patent: Mar. 18, 2008

(54) PORTABLE LAMP

(75) Inventors: Aidan Petrie, Jamestown, RI (US); Marco Wo, Providence, RI (US); Justin Sirotin, Providence, RI (US)

(73) Assignee: Thule Sweden AB, Hillerstorp (SE)

( * ) Notice: Subject to any disclaimer, the term of this patent is extended or adjusted under 35 U.S.C. 154(b) by 268 days.

(21) Appl. No.: 10/635,934

(22) Filed: Aug. 7, 2003

Related U.S. Application Data

(60) Provisional application No. 60/319,452, filed on Aug. 7, 2002.

(51) Int. Cl.
*F21V 21/008* (2006.01)

(52) U.S. Cl. ..... 362/391; 362/199

(58) Field of Classification Search ..... 362/157, 362/183, 187, 197, 199–208, 220, 269, 274, 362/277, 282, 391, 394, 190, 396, 402, 427, 362/436, 439

See application file for complete search history.

(56) References Cited

U.S. PATENT DOCUMENTS

| | | | | | |
|---|---|---|---|---|---|
| 1,826,864 | A * | 10/1931 | Buchholz | 362/191 |
| 2,386,255 | A * | 10/1945 | Morey | 362/197 |
| 4,399,498 | A * | 8/1983 | Bacevius | 362/396 |
| 4,417,299 | A * | 11/1983 | Rupp | 362/186 |
| 5,019,951 | A * | 5/1991 | Osterhout et al. | 362/191 |
| 5,103,384 | A * | 4/1992 | Drohan | 362/191 |
| 5,510,970 | A * | 4/1996 | Hollenbach et al. | 362/396 |
| 6,224,235 | B1 * | 5/2001 | Parker | 362/190 |
| 6,457,840 | B2 * | 10/2002 | Maglica et al. | 362/183 |
| 6,517,215 | B2 * | 2/2003 | Mele | 362/203 |

* cited by examiner

*Primary Examiner*—Hargobind S. Sawhney
(74) *Attorney, Agent, or Firm*—Novak Druce + Quigg LLP

(57) ABSTRACT

A portable lamp is provided having a housing having a front end, a rear end and at least a pair of walls there between; and a spring actuated grip attachable to the housing whereby the flashlight is able to be hung from a stationary member; wherein the grip is able to be actuated by one hand of a user of the flashlight. A method for securing the portable lamp is further provided.

11 Claims, 3 Drawing Sheets

PORTABLE LAMP

CROSS-REFERENCE TO RELATED APPLICATIONS

The present application claims the benefit of United States Provisional Patent Application No. 60/319,452 filed 7 Aug. 2002. Said application is expressly incorporated herein by reference in its entirety.

BACKGROUND OF THE INVENTION

1. Technical Field

The present invention generally relates to portable lighting devices. More specifically, the present invention relates to a flashlight lamp that is attachable to a variety of surfaces or objects.

2. Background Information

Flashlights have been available for use for many years. Typically, the flashlight is designed as a cylinder with a lens at one end from which a beam of light is emitted. The cylindrical design is functional in that it provides a storage chamber for one or more batteries used in operating the flashlight. The design is also convenient for gripping and carrying the flashlight.

Other designs are also known, such as a handle mounted on top of a battery source with a lens projecting forwardly either separate from or as a part of the case or housing for the battery source. These designs offer the convenience of providing a stable base or bottom for the light to stand on, with the handle positioned on top, when not carried.

Other modifications to these lights are also known, such as providing a lens covering of various colors, or enabling the light to flash intermittently. Separate clips and rings have also been provided as accessories to traditional flash lights for allowing the light to be secured to such things an operator's pant pocket, or hung from a support such as a hook or nail.

Still, there is a need for a flashlight or portable lamp that can be easily secured to a variety of surfaces, from one that is narrow and flexible, such as a seat pocket on the back of a seat in a vehicle or a wire or tree limb, to one that is wide and irregularly shaped, such as a curved hood or trunk of a vehicle, or a car door, or a portion of a load carrier such as a lip of a cargo box, or the frame of a bicycle.

SUMMARY OF THE INVENTION

The present invention provides a flashlight or portable lamp designed to satisfy the aforementioned need by providing a securing arrangement or clamp for attaching the light to a supporting object or surface. Further, the lighting device of the present invention is provided with one or more legs that enable the device to stand upright on a substantially flat surface, such as the ground or the roof of a vehicle, when not suspended by means of the clamp or grip.

Accordingly, the present invention is directed to a portable lighting device having a housing that has at least one lamp element disposed at a front end of the device; a handle adjacent to the housing for carrying the device; a clamp able to secure the device to a variety of surfaces; and an actuator tangent to the clamp for operating the clamp when securing the device to the surface. The lighting device includes a base for standing the device upright without operator assistance. The base of the device can include one or more legs used in balancing the device to keep it in its upright position when standing. Instead of such leg(s), a side of the device may be adapted to present a balancing surface upon which the light can stand for distributing light over a work area.

Preferably, the handle is built or molded into the housing. The switch for turning the lamp on and off is ergonomically placed near the handle so that a person carrying the lamp by the handle can easily reach the switch with one finger, and preferably the thumb, from the hand carrying the lamp. The hand-grip portion of the device is pivotably positioned upon the light emitting portion so that the hand of an operator carrying the lamp can easily manipulate the device when securing the lamp to a supporting surface. A clip or clamping extension is connected to, and projects away from the hand-grip portion. This clamping extension is spring-biased toward the body of the lighting device for making a grasping connection to a supporting object when operator opening actuation is released. With this design, the other hand of a person using the lamp is left free.

The lighting device may have one or more intensities or brightness of light beams. Preferably, the light created by the device is one that is dispersed up to about 120 degrees from the light, such as the light created by a room light, rather than focused, such as the beam of light created by a traditional flashlight or vehicle headlight. The device can further include one or more elevations for protecting the lens of the light from breaking when dropped or knocked against an object.

The portable lamp can also include a storage compartment. This compartment can serve to carry any of a number of objects, such as first aid articles, food, and tools. Preferably, the compartment carries additional batteries or a cord for use in recharging the lamp. Most preferably, the cord is one adapted for plugging into the cigarette lighter or 12 volt plug of a vehicle. The light preferably can be used when recharging.

The clamp of the present invention is unlike belt clips found on flashlights known in the art. As named or referred to, those clips typically are an extension of the case of a cylindrical flashlight, located substantially adjacent to the case. The clips offer a slight flexibility, enabling them to slip over the belt or pants pocket of a person for carrying the flashlight. In contrast to those clips, the clamp of the present invention is able to pivot or rotate to an extended position that can be as much as ninety degrees outwardly from the case or housing of the lamp over a surface thicker or larger than a belt or pants pocket. These surfaces or objects can include a vehicle door, hood or trunk, or a cargo carrier. While having the strength to clamp to such larger objects, the clamp is still preferably thin in design so that it can be applied to a thin and flexible object, such as a seat pocket typically found on the rear seat of a vehicle.

The present invention also provides a method of securing a portable lamp to an object. With this method, the lamp is provided with a lumination source and a handle opposite the lumination source. A spring-biased securing arrangement is associated with the lamp's handle that is configurable to form a clamping mechanism capable of suspending the lamp from a supporting object. With the lamp grasped by its handle, the securing arrangement is raised from the housing of the lamp. In a preferred embodiment, this movement of the clamping mechanism away from the lamp's body is accomplished by rotation or pivotation of the grasped lamp handle that is connected to the extendable clamp member. Alternatively, extension of the clamp member may be accomplished by extending one or more fingers that are grasping the handle against an actuating lever. In doing so, a gap-space is created for receiving an object upon which the lamp is to be secured. The support object is positioned into the space created between the securing arrangement and the lamp and the biasing spring is allowed to take control and urge the clamp member toward the lamp body with the supporting object therebetween. This allows the securing arrangement to move towards the lamp body thereby securing the lamp onto the object.

These and other features and advantages of the present invention will become apparent to those skilled in the art upon a reading of the following detailed description when taken in conjunction with the drawings, wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
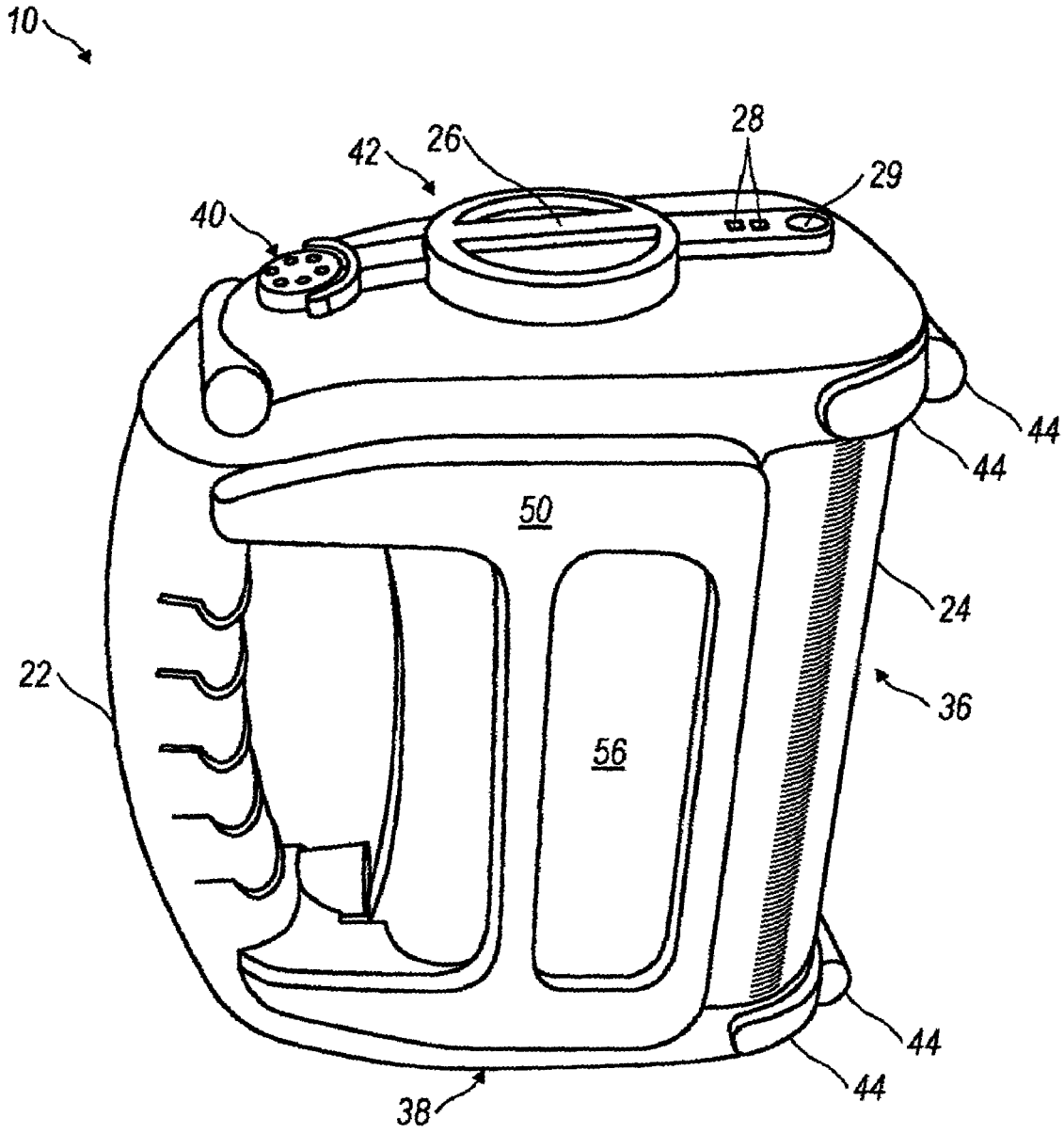
FIG. 1 is a side perspective view of a portable lamp according to the present invention.
Figure 2:
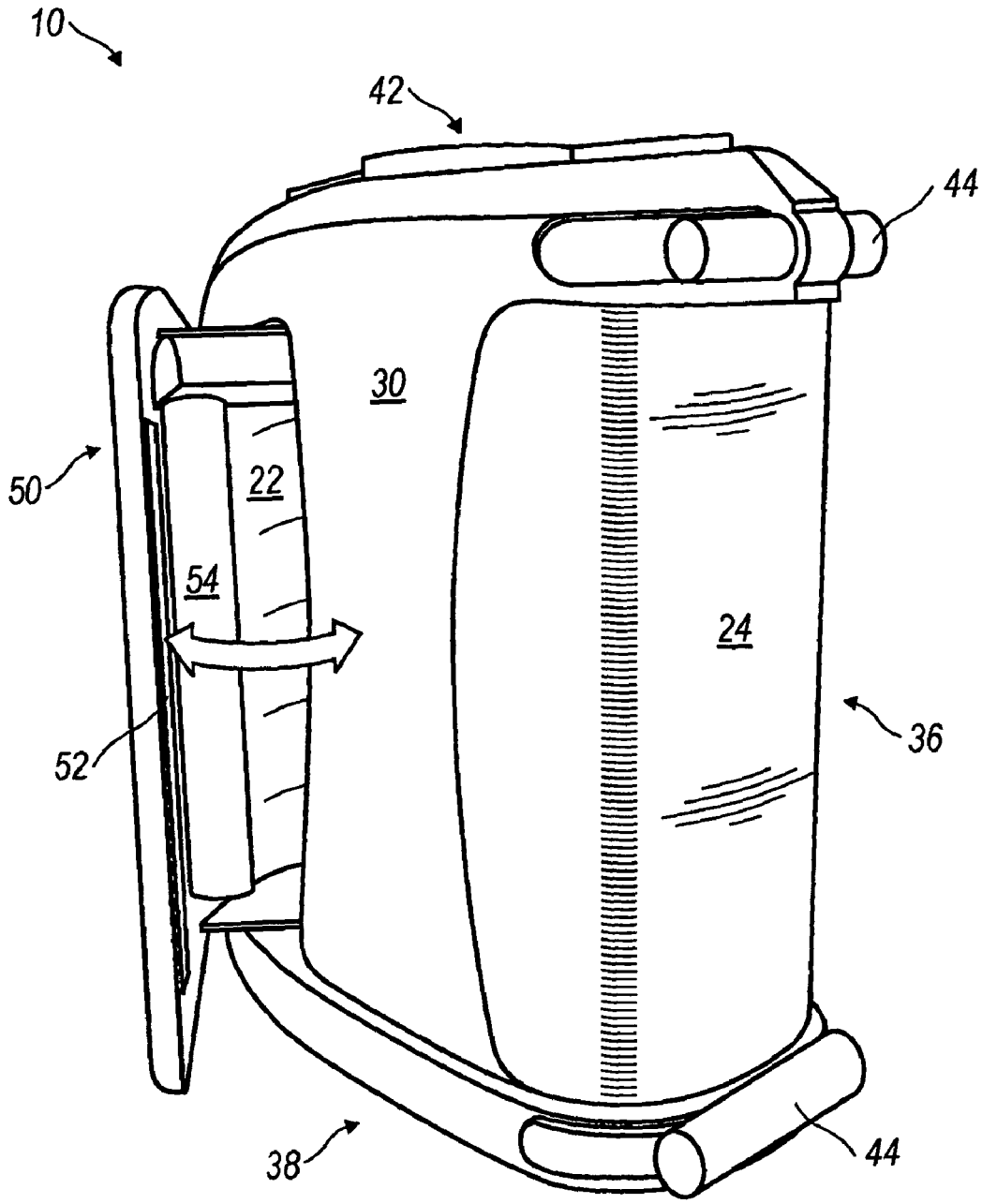
FIG. 2 is a front perspective view of a portable lamp according to the present invention, illustrating the motion of a clamp provided by the lamp of the present invention.

Referring now to the drawings in general, the lighting device 10 includes a case or housing 20, a handle 22 for carrying the lighting device, and a clamp or grip 50 for securing the lamp 10 to a surface or object. The housing 20 and portions of the handle 22, or at least supports for the handle 22 can be molded as one piece.

The housing 20 includes a front 36, a rear 34, at least a pair of walls or sides 30, 32, and a base 38. By describing the housing 20 as having a front and a rear, it should be understood that such elements are provided for references for use in describing the lamp 10, and are not meant to imply a permanent fixture, such as the front of a house or front of a vehicle. The front 36 of the housing 20 includes at least one lens 24 from which a light source is emitted. Preferably, the light emitted from the lens 24 is more broadly dispersed, outwardly lighting an area in an arc of up to about 120 degrees, as opposed to a more concentrated or direct light beam that is typically provided by a flashlight. In an alternative embodiment not shown, an additional lens is provided that serves in giving a more concentrated light beam. Further, the intensity of the light emitted can preferably vary in intensity.

The handle 22 is positioned at the rear 34 of the device 10. The handle 22 is preferably slightly curved in shape, so as to comfortably fit the hand of a user of the lamp 10. Further, the handle can include one or more ridges for improving the grip of the fingers holding the lamp 10.

The housing 20 includes a switch or light actuator 40 for turning on and off the light beam. Preferably, the switch 40 is placed near the handle 22 so that it can be pressed on and off by the hand of the user that is gripping the handle 22. The switch 40 can include a ridge at least partially surrounding it for preventing the lamp 10 from being accidentally turn on or off when bump or hit against an object.

The housing further includes a compartment having a door 26 for storing any of a variety of items therein. For example, tools or batteries can be stored therein. Preferably, an outlet cord is stored therein for use in recharging the lamp 10. More preferably, the cord is provided with an adapted for recharging the lamp 10 with a 12 volt outlet of a vehicle. Further, the lamp 10 can preferably be used during charging. The compartment door 26 can be secured to the housing 20 by any of a variety of ways known by one skilled in the art, such as snapping the door 26 onto the housing 20, or screwing the door 26 onto the housing 20.

The housing can included a charge outlet 28 for plugging the charging cord into. In an optional embodiment, the housing 20 can include a charge indicator 29 for indicating that charging of the lamp 10 is occurring, and/or that the lamp 10 power source is fully charged.

Figure 3:
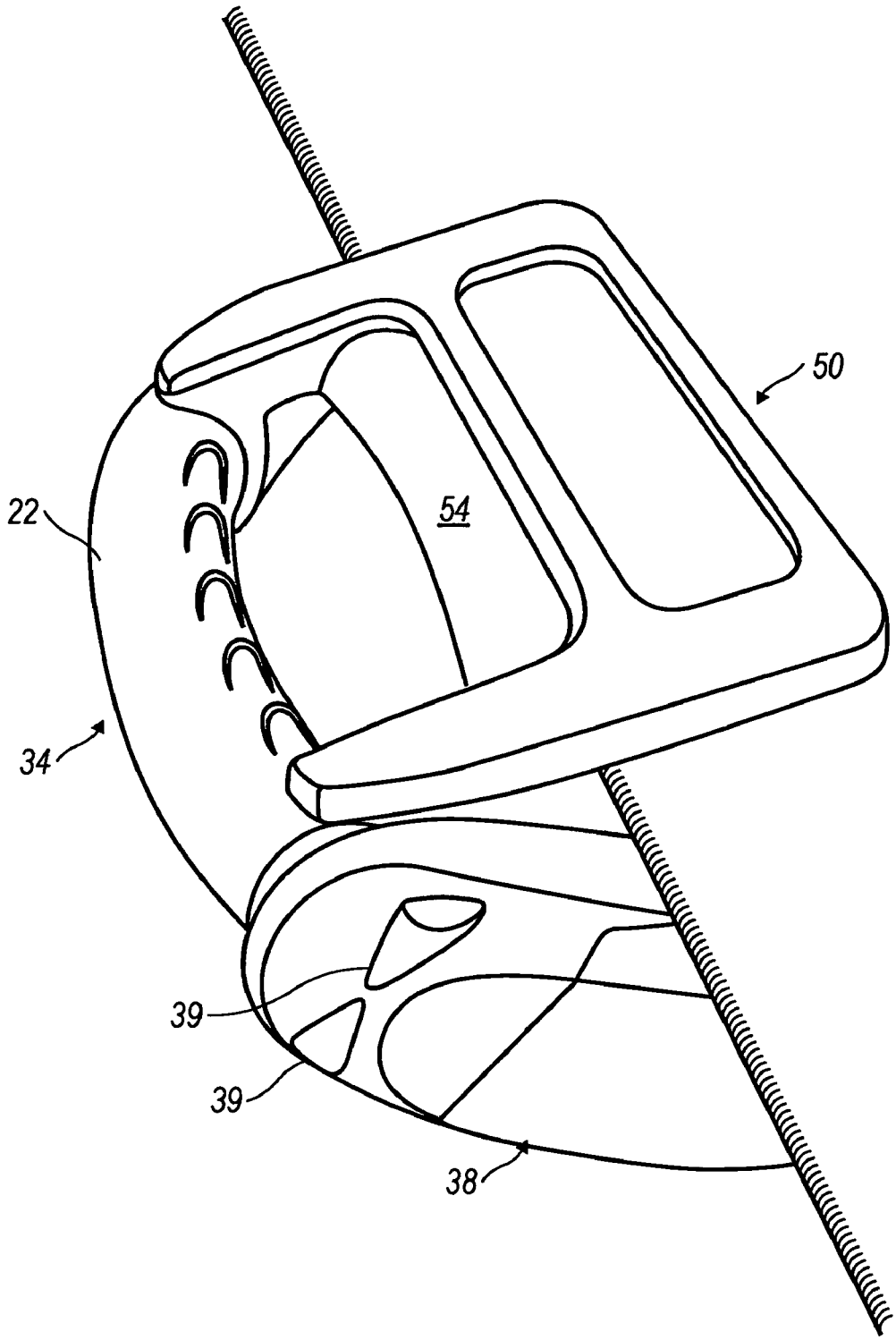
FIG. 3 is a side perspective view of a portable lamp according to the present invention, illustrating the lamp secured to a surface.

The lamp 10 further included a base 38 on which the lamp 10 can stand when not being carried or secured to an object. The base 38 should allow the lamp 10 to stand on any substantially flat surface, such as the roof or hood of a vehicle, the ground, a floor, or a table. To further support the lamp 10 when standing on its base 38, the lamp can optionally include one or more feet 39 for enhancing the lamps' 10 stability. In FIG. 3, two rear feet 39 are shown. However, it should be recognized that the design of the lamp 10 is not limited to such feet 39 as illustrated. For example, a single foot 39 can extend across the rear 34 of the base 38 of the lamp 10. Further, the base 38 itself can be extended rearward to provide more stability.

Towards the front 36 of the lamp 10, the housing 20 can include one or more elevations or ridges 44 positioned about the lens 24. The ridges 44 are designed to surround the lens 24 so as to catch and absorb the impact of a drop, thereby avoiding breaking the lens 24.

Adjacent to both the handle 22 and the housing 20 of the lamp 10 is a clamp or grip or securing arrangement 50. Preferably, the clamp 50 is spring actuated, with the tension of the spring such that the clamp 50 is biased towards the housing 20. In one embodiment, the side of the clamp 50 adjacent to the housing 20 is provided with a grip or grip pad 52 for preventing the lamp 10 from slipping off an object when secured thereto. This pad 52 can be co-molded into the internal surface of the clamp 50 (i.e., the side adjacent to the housing 20), providing a rubberized or rubber-like surface for enhancing frictional contact with an object.

The clamp 50 further includes a clamp actuator or lever 54 tangent or adjacent to the clamp 50 for operating the clamp when securing the device to the surface. Preferably, the lever 54 is integral with the clamp 50. The lever 54 extends away from the clamp 50, preferably at an angle of about ninety degrees from the clamp 50. The lever 54 is placed between the handle 22 and the housing 20. By doing so, a person carrying the lamp 10 can simply extend one or more fingers against the lever, thereby pivotally pushing or moving the clamp 50 away from the housing 20, creating a space for receiving an object that the lamp 10 is to be secured onto. The surface 56 of the clamp 50 can serve as a location for placing the mark or brand name of the lamp 10.

In a preferred embodiment, the clamp 50 is co-molded, or at least fixed to the grip-adapted handle 22. The handle 22 itself is rotatably or pivotably coupled to the main body of the lamp. The graspable portion of the handle is formed about a functional axle that serves as an axis about which rotation of the clamp 50 occurs. In this way, rotation or twisting of the graspable handle relative to the lamp body actuates the clamp 50 to an open position against a biasing spring that continually urges the clamp toward the lamp body. In this embodiment, no additional actuating lever is required for the clamping mechanism.

In practice, the rotatable handle 22 is twisted relative to the lamp body against the force of the biasing spring. The twisting action that overcomes the bias of the spring can be accomplished against the weight of the lamp body. More typically, however, this twisting action that overcomes the bias of the spring will be accomplished by essentially anchoring the lamp body by placing it against the object upon which it is to be clamped. With the lamp body in abutting engagement with the object and functionally fixed thereto, the grip portion of the handle is twisted thereby rotating or pivoting the clamping portion away from the lamp body where it had been nested. This forms a receiving gap space between the clamp portion of the lamp and the object upon which the lamp is to be secured.

With the gap space established, the lamp may be manipulated so that a portion of the supporting object is located therein. In most cases, this will mean pushing the now-open mouth of the clamping lamp over a portion of the support object. From a practical stand point, the body of the lamp which has been placed in abutting engagement with a portion of the support object is slid along the object so that part of the object is positioned inside the gap space. The grip is then permitted to rotate back toward the starting position with the clamp portion simultaneously moving back toward the lamp body under the action of the biasing spring. The force or power of the spring is sufficient to close the mouth or gap space with sufficient force to secure the lamp to the supporting object.

Referring back to the drawings, the shown embodiment of the lamp 10 is secured onto a surface or object as follows. The lamp 10 is provided with a lens or lumination source 24 at one end 36, and a handle 22 at the opposite end 34 of the lumination source 24. A securing arrangement 50 is attached to the lamp adjacent to the handle. The securing arrangement 50 is preferably spring actuated, and pivots about an axis on a hinge to which it is connected on the handle 22 or at the rear 34 of the housing 20. While grasping the lamp 10 by the handle 22, a person extends one or more fingers against a lever 54. The lever 54 is preferably an extension of the securing arrangement most adjacent to the hinge. Further, the lever 54 extends outwardly from the axis of rotation, thereby allowing the securing arrangement to be raised from the lamp 10 when pushed by the fingers. This creates a space for receiving an object to secure the lamp 10 onto. The object is inserted into the space created between the securing arrangement 50 and the housing 20, and the finger(s) is (are) retracted from the lever 54, thereby lowering the securing arrangement 50 towards the lamp 10 and securing the lamp 10 onto the object. In like manner, when removing the lamp 10 from the object that it is secured to, a person grasps the handle 22 and pushes against the lever 54, raising the securing arrangement 50 and allowing the lamp 10 to be pulled off the object.

While particular embodiments of the invention have been herein illustrated and described, it is not intended to limit the invention to such disclosures, but changes and modifications may be made therein and thereto within the scope of the following claims.

What is claimed and desired to be secured by Letters Patent is:

1. A flashlight comprising:

a housing having at least one light source disposed at the front end of the flashlight;

a handgrip handle rotatably connected to said housing for rotatable motion relative thereto about a pivot axis coincident with a longitudinal axis of the handgrip handle;

a clamping member directly connected to said handgrip handle for pivotation about the pivot axis together with said handgrip handle, said handgrip handle and said clamping member together form a clamping assembly; and a biasing assembly disposed between said clamping assembly and said housing which biases said clamping member in a direction toward said housing and thereby requires operator actuation to affect pivotation of said clamping member about the pivot axis of said handgrip handle in a direction away from said housing.

2. The flashlight according to claim 1, wherein the housing further comprises a base for standing the flashlight upright thereon.

3. The flashlight according to claim 2, wherein the base further comprises at least one foot for balancing the flashlight when standing on the base.

4. The flashlight according to claim 1, wherein the housing further comprising at least one elevation for protecting a lens of the flashlight from breaking.

5. The flashlight according to claim 1, wherein the housing further comprises a compartment for storage defined at least in part by said housing.

6. The flashlight according to claim 5, wherein the compartment contains at least one item selected from the group consisting of tools, batteries, and electrical cord able to plug into an electrical outlet for recharging the flashlight, and an electrical cord able to plug into a cigarette lighter of a motor vehicle for recharging the flashlight.

7. The flashlight according to claim 1 wherein said handgrip handle is actuated by a hand an operator that is holding the handgrip handle.

8. The flashlight according to claim 1 further comprising a switch for turning on and off the flashlight, wherein the switch is accessibly positioned near the handgrip handle on a top end of the flashlight for reach by an operator of the flashlight that is holding the handgrip handle.

9. The flashlight according to claim 8 wherein the flashlight provides one or more intensities of lighting by operation of the switch.

10. The flashlight according to claim 1 wherein the clamping member is securable to any surface selected from the group consisting of a motor vehicle roof, a motor vehicle hood, a motor vehicle trunk, a seat pocket on a motor vehicle seat, and motor vehicle luggage box.

11. The flashlight of claim 1 wherein said clamping assembly is fixedly connected to said handgrip handle, said handgrip handle is pivotal with respect to said housing and about a longitudinal axis of said handgrip handle, and said biasing assembly is disposed between said handgrip handle and said housing.

* * * * *